United States Patent [19]

Keane, Jr.

[11] 4,149,344

[45] Apr. 17, 1979

[54] SINGLE-POINT BLOCKING METHOD OF SURFACING AND EDGING SPECTACLE LENSES

[75] Inventor: Gordon H. Keane, Jr., Portland, Oreg.

[73] Assignee: Computer Management Services, Inc., Portland, Oreg.

[21] Appl. No.: 842,552

[22] Filed: Oct. 17, 1977

Related U.S. Application Data

[62] Division of Ser. No. 646,486, Jan. 5, 1976, abandoned.

[51] Int. Cl.[2] ..... B24B 1/00

[52] U.S. Cl. ..... 51/284 E; 51/277; 51/284 R

[58] Field of Search ..... 51/105 LG, 216 LP, 277, 51/284, 284 E; 350/178; 351/177

[56] References Cited

U.S. PATENT DOCUMENTS

| | | | |
|---|---|---|---|
| 2,352,616 | 7/1944 | Canning | 51/216 LP |
| 2,545,447 | 3/1951 | Clement | 51/284 X |
| 3,015,196 | 1/1962 | Campbell | 51/277 X |
| 3,049,766 | 8/1962 | Buckminster | 51/216 LP |
| 3,152,427 | 10/1964 | Prunier | 51/277 |
| 3,192,676 | 7/1965 | Buckminster | 51/216 LP |
| 3,507,076 | 4/1970 | Rudd | 51/277 |
| 3,686,796 | 8/1972 | Clark | 51/284 X |

*Primary Examiner*—Gary L. Smith
*Attorney, Agent, or Firm*—Chernoff & Vilhauer

[57] ABSTRACT

A method of surfacing and edging spectacle lenses utilizing single-point blocking of each lens for both the surfacing and edging operations. The single point utilized is the frame, or pattern, center of the lens. The process is applicable to sphero-cylindrical lenses as well as pure spherical lenses, and in its preferred form requires only a single block attachment step to accomplish both the surfacing and edging processes.

1 Claim, 3 Drawing Figures

SINGLE-POINT BLOCKING METHOD OF SURFACING AND EDGING SPECTACLE LENSES

This is a division of application Ser. No. 646,486, filed Jan. 5, 1976, and now abandoned.

BACKGROUND OF THE INVENTION

The present invention relates to spectacle lens production, and more particularly to the use of single-point lens locking for surfacing and edging of sphero-cylindrical (toroidal) lens surfaces.

Spectacles (framed eyeglasses) commonly utilize lenses having a convex outer surface and a concave inner surface having one or more different radii of curvature. In the simplest form of such lenses, both the inner and outer surfaces are spherical. However for many users the inner surface is in the shape of a section of a torus, commonly referred to as a sphero-cylindrical surface, since the surface is formed by generating two curved surfaces of different radii at right angles to one another. The direction along which the longer radius is generated is referred to as the cylinder axis of the lens. Regardless of type, such lenses are produced from a glass or plastic blank by generating the inside surface according to a prescription by first roughly cutting the desired curved shape and thereafter performing one or more stages of abrasive fining and subsequently one or more stages of polishing. Thereafter the peripheral edge of the lens is cut to a shape to match the desired frame. Preparatory to the surfacing and edging processes, respective blocks are adhered to the outer lens surface in respective positions to provide a means of holding the lens for the particular operation.

An eyeglass prescription for a typical lens specifies, among other things, the refractive power to be produced by the lens or the respective sphere and cylinder powers in the case of a sphero-cylindrical lens, the location of the cylinder axis relative to the frame for a sphero-cylindrical lens (along which the sphere power is generated), and the decentration, that is the distance and direction (usually horizontal) from the center of each frame to the corresponding optical center of the lens to be placed therein, in terms of both the left and the right eye. In some cases the prescription will also specify a particular prism, that is, a tilt in a predetermined direction of the lens surface relative to the frame, and the location of lens segments relative to the frame for multifocal lenses.

In the conventional production of a spectacle lens, points on the outer surface of an appropriate lens blank are selected to correspond to the frame center and optical center of the lens respectively. Typically the selected frame center point is the center of the blank, except in multifocal lenses where the position of the segment relative to the frame has been specified, thereby dictating some other position for the frame center. Once the frame center is selected, the optical center for the lens may be determined by moving a distance from the frame center corresponding to the decentration prescribed. A lens holding block is then normally attached by commonly known adhesion methods to the outer lens surface with its center corresponding to the optical center of the lens so as to provide a means of holding the lens while the interior surface is generated by an appropriate cutting tool of any conventional type well known to the art. After the rough surface is cut one or more grinding and polishing steps are performed to finish the surfacing. The block is then removed and the lens is cleaned and checked for accuracy using a lensometer. Subsequently, the lens is again blocked, this time with the center of the block corresponding to the frame center, and the lens is placed in a machine for producing the edge configuration required for mounting the lens in the specified frame. When the edging is completed the second block is removed and the lens is cleaned and mounted in the frame.

The aforementioned conventional process for producing lenses requires complex dual positioning of lens blocks and thereby often leads to positioning errors causing the lens to be discarded and redone. More important, the mounting of the lens block at the optical center of the lens blank preparatory to surface generation can result in an uneven distribution of force during the fining and polishing steps which produces uneven surfacing and concomitant unwanted tilting and distortion, requiring costly further surfacing steps to correct. This adverse result is caused by the fact that the prescribed optical center of the lens is usually far enough from the outer center of mass of the lens blank to produce substantial imbalance when the block, located at the optical center, is gripped for fining and polishing. This imbalance cannot effectively be corrected by "cribbing" or cutting away excess lens blank material around the edges because the later relocation of the block to the frame center of the lens for edging will require the use of much of the excess material in the ultimate formation of the edge.

Moreover the conventional dual attachment and detachment of the lens blocks increases the likelihood of lens breakage, and in any event requires costly extra steps.

A system has previously been developed employing an adjustable, multi-piece block structure which requires only a single attachment of the block to the lens blank for both the surface generation and edging processes. However such process requires time-consuming adjustment of the relative positions of the multiple pieces of the block and, more important, conventionally utilizes the optical center for surface generation and the frame center for edging, thereby failing to cure the aformentioned problems of error incident to multi-point blocking and imbalance and uneven surfacing due to optical-center blocking during fining and polishing.

It has heretofore also been known that frame-centered surfacing of lenses can be accomplished in the production of a simple spherical surface by the application of "prism", that is by tilting a lens blank, which is blocked at the frame center rather than optical center, relative to the cutting tool by means of a tapered spacer known as a "prism ring" such that the optical center will be produced with the correct amount and direction of decentration. However it has not previously been known how to utilize the "prism" technique in correctly decentering the optical center of sphero-cylindrical surfaces. Accordingly use of frame-centered blocking during surfacing of lenses has not been feasible for the mass production of spectacle lenses because uniformity of technique for both spherical surfaces and sphero-cylindrical surfaces is necessary.

Accordingly there is a need for a system of surfacing and edging spectacle lenses applicable both to spherical and sphero-cylindrical lenses which does not require blocking at two separate centers for the surfacing and edging processes, but rather permits blocking only at the frame center of the lens blank for both processes, whereby imbalance and uneven force application during the surfacing process can be minimized and cribbing may be more effectively utilized to eliminate unneeded glass and its associated imbalance. Moreover such process should preferably require only a single block attachment step, at the frame center, to accomplish both processes and thereby eliminate costly steps and breakage.

SUMMARY OF THE PRESENT INVENTION

The present invention is directed to a method of surfacing and edging spectacle lenses utilizing the same blocking point for both the surfacing and edging operations, such point being the frame center of the lens. While in its broadest sense the method encompasses dual attachment of blocks at the same point for the respective operations, the process is preferably practiced requiring only a single block attachment step to accomplish both operations. The process is applicable to sphero-cylindrical lenses as well as purely spherical lenses by virtue of the fact that an accurate method of decentering the optical center of a sphero-cylindrical lens, utilizing prism in a frame-centered surfacing operation, has been devised. The process is also applicable to different lens materials having different indices of refraction. Thus the method is adapted to the mass production of spectacle lenses.

In the practice of the process, the frame center (i.e. frame pattern center) is selected as previously described, either in the center of the lens blank or relative to prescribed lens segment location for a multi-focal lens. The block is adhered to the outer surface of the lens blank with the center of the block corresponding to the frame center. For generating the curve of the inner surface of a purely spherical lens, the amount and direction of prism to be applied to decenter the optical center the prescribed amount requires only an elementary calculation utilizing Prentice's rule, described hereafter, to determine the required prism. Since all axes of a purely spherical lens are spherical, the prism resulting from this calculation can be applied directly to the direction of decentration prescribed (usually along the horizontal axis of the lens), and the machine operator need merely orient the appropriate tapered prism ring or spacer in that direction to achieve the necessary tilt between the lens blank and the cutting tool. This process has been accomplished previously in the art with spherical lenses, as stated above.

With sphero-cylindrical lenses, the problems of decentration utilizing prism are much different. The problems arise from the fact that in a sphero-cylindrical lens there are only two axes that are truly spherical surfaces, i.e. along the cylindrical axis and along the axis 90° thereto. In all other axes the lens is aspherical. Accordingly, if prism is to be used to decenter the optical center of a sphero-cylindrical lens along an axis oblique to the cylinder axis, the foregoing simple application of Prentice's rule is impossible because the relationship of the rule applies only to a spherical surface, i.e. a curved surface of constant radius. It has however been discovered that decentering along an aspherical axis of a sphero-cylindrical lens may be accomplished with sufficient accuracy by multiple applications of Prentice's rule and rotation of axes from the desired direction of decentering to the prescribed cylinder axis of the lens to obtain prism power components, the conversion of the prism power components to a resultant prism power, and a reconversion of the resultant prism power back to the original prescribed axis of decentration. The mathematical tasks necessary to accomplish this objective can be done manually in the manner set forth hereafter, or by the use of a computer to save time. The result of the calculations provides the cutting tool operator with the necessary prism power setting whereby the lens will be held at a proper tilt angle in the proper direction relative to the cutting tool to cause the optical center of the lens, resulting from the ensuing surfacing operation, to be decentered from the frame center at the distance and direction set forth in the prescription.

Because the lens block is centered on the frame center rather than the optical center during this surfacing operation, the lens blank may be cribbed previous to the surfacing operation to remove maximum excess edge glass without any danger of removing too much so as to interfere with the subsequent edging operation, thereby minimizing imbalance during surfacing. Moreover, when frame-centered blocking is utilized for both surfacing and edging, it has been found that smaller blanks may be utilized to produce more types of lenses than is presently possible because of the need for less excess edge material, thereby saving cost by minimizing blank size and wasted glass.

Upon completion of the surfacing process, the block may be removed and replaced with another block centered on the same frame center point for the edging operation. The replacement of one block with another may be deemed necessary if the edging machine requires a different size block. However since the block for each operation is centered on exactly the same point, it is preferable that the surfacing and edging machinery be constructed so as to be capable of gripping the same block or portion thereof, so that only one step of adhering or otherwise attaching a block to the lens blank is necessary to accomplish both the surfacing and edging operations. Loss resulting both from error and breakage of lens blanks can be greatly reduced in this manner.

Accordingly it is a primary objective of the present invention to provide a high-production method of surfacing and edging framed lenses, whether of the spherical type or sphero-cylindrical type, utilizing single or same-point blocking for both the surfacing and edging processes, such point being the frame center of the lens.

It is a further objective of the present invention that the same block or portion thereof be utilized for both the surfacing and edging processes so as to require only one step of attaching the block to the lens to accomplish both processes.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
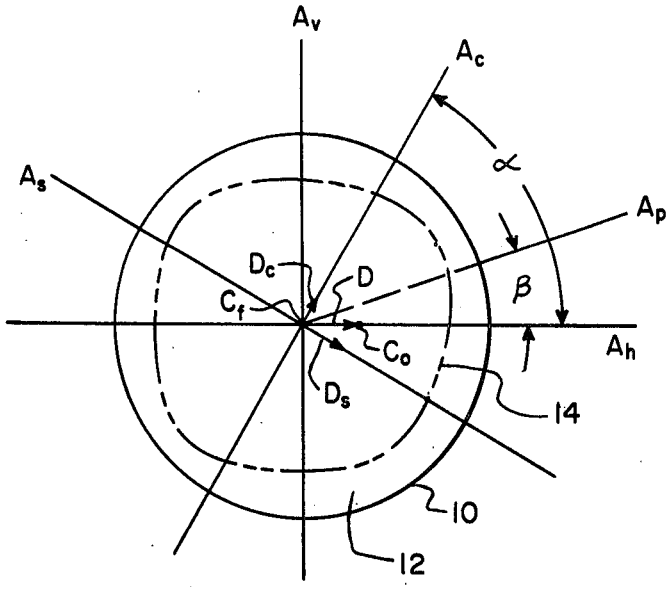
FIG. 1 is a front view of a spectacle lens blank laid out in relation to a spectacle half-frame and showing the associated frame coordinate system.

Referring to FIG. 1 a lens blank 10, comprising a thick, disc-shaped glass block having a front surface 12, with a predetermined base curve, is prepared ("set up") for production of a spectacle lens utilizing a cartesian coordinate system superimposed upon the lens blank wherein the frame horizontal axis Ah corresponds to the horizontal dimension of the prescribed spectacle frame, the frame vertical axis Av corresponds to the vertical dimension of the spectacle frame and the intersection Cf of the two frame axes corresponds to the center ("frame center") of the respective frame 14 for which the lens is to be prepared. In the case of single vision lenses, the frame center Cf is arbitrarily located at the physical center of the lens blank to ensure the maximum availabilty of glass for surfacing the inside of the lens and subsequent edging. However, in the case of multifocal lenses where the blank includes a segment of material to produce a different refractive power, the prescription will have specified the position of the segment relative to the frame, so the frame center must be chosen to achieve the specified segment position which may place the frame center at other than the physical center of the lens blank.

Since the prescription specifies the pupilary distance of the user (i.e. horizontal distance between the pupils of the two eyes) and the horizontal separation of the centers of the two frames is known once the frame style is selected, the position of the optical center Co of the lens, which will ordinarily lie on the horizontal frame axis Ah, is conventionally computed relative to the frame center by mere subtraction of one-half the pupilary distance from one-half the frame center separation, resulting in a horizontal decentration distance D by which the optical center Co must be offset from the frame center Cf. Some prescriptions may perform this calculation in advance and specify the actual decentration D. Also the prescribed decentration may not always be along the horizontal frame axis Ah, but since the principles applied for purposes of this invention are the same regardless of the direction of decentration, the normal case of horizontal decentration will be assumed for the sake of clarity.

Figure 2:
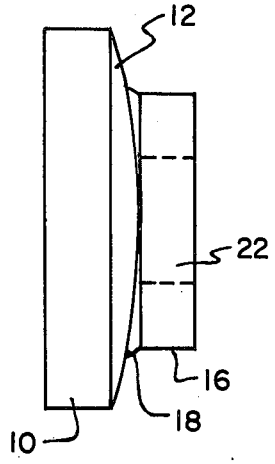
FIG. 2 is a side elevation of a typical blocked lens blank ready for surfacing.

Turning momentarily to FIG. 2, the lens blank 10 is ordinarily prepared for surfacing by attaching a round lens block 16 to the front surface 12 of the lens blank utilizing lead 18 and an adhesive between the lead and the lens (not shown), so that a chuck of a lens cutting tool may hold the lens for surfacing by gripping the block. While this technique is commonly used and is anticipated for application of the present invention, it is recognized that other means for holding the lens in the proper position might also be utilized, and are intended to be included within the scope of the terms "block", "blocked" and "blocking" as used in the specification and claims.

In the past the lens block 16 has conventionally been placed with its center directly over the optical center Co, preparatory to surfacing. However, for the abovementioned reasons, the method of the present invention requires centering of the lens block at the point Cf corresponding to the frame center preparatory to the surfacing operations.

In surfacing lenses which have a simple spherical inner surface and have been blocked at the frame center Cf, the optical center Co can be shifted the required amount along the axis Ah or any other prescribed axis of decentration from the frame center Cf during the surfacing process merely by tilting the lens blank 10 and block 16 with respect to the cutting tool chuck (i.e. introducing "prism") along the axis of decentration an amount computed according to Prentice's rule as follows:

$$Pd = DR/10$$

where

Pd = the amount of prism power, expressed in prism diopters, along the axis of decentration, D = the amount of decentration (expressed in millimeters), R = the refractive power of the lens, expressed in diopters.

Conventional tapered prism rings normally used to accomplish tilt during surface cutting are marked in prism diopters and can be selected directly from the results of this calculation.

However, where a sphero-cylindrical lens is to be produced, the prescription frequently requires an angle for orienting the cylinder axis Ac of the lens obliquely relative to the horizontal frame axis Ah. If the direction of decentration in such case is along Ah or some other axis oblique to the cylinder axis Ac, the optical center Co can no longer be properly decentered simply by introducing prism along the prescribed direction of decentration. Nevertheless, a method has been devised according to the present invention utilizing prism to shift the optical center from the frame center in all sphero-cylindrical surfaces. To compute the amount of direction of the necessary prism, the prescribed decentration (in this case along Ah) is resolved geometrically into vectorial components along the cylinder axis Ac, which is at an angle $\alpha$ with respect to Ah, and its associated axis As (90 degrees from Ac), as follows:

$$Dc = D \cos(-\alpha)$$

$$Ds = D \sin(-\alpha)$$

where

Dc equals the component of decentration along the cylinder axis Ac and

Ds equals the component of decentration along the axis As.

Thereafter, the prism power components along the axes Ac and As (which are the only truly spherical axes of constant refractive power) are computed as follows:

$$Pc = DcRc/10$$

$$Ps = DsRs/10$$

where

Pc equals the prism power component along the cylinder axis Ac,

Rc equals the spherical refractive power of the lens along the cylinder axis as specified by the prescription, Ps equals the prims power component along axis As, and Rs equals the refractive power of the lens along the axis As.

For practical reaons, that is, because of the tool conventionally utilized to introduce prism into the surfacing of a lens, the prism power components along the axes Ac and As respectively are combined into a single resultant prism power $P_\beta$ along an axis Ap at angle $\beta$ relative to the axis Ah, as follows:

$$P_\beta=\sqrt{Pc^2+Ps^2}$$

$$\beta=\tan^{-1}(Ps/Pc)+\alpha$$

Once the foregoing calculations are completed the necessary parameters relative to the frame coordinate system (Ah, Av) for surfacing the lens are known. At this point, these parameters are marked on the lens blank by placing a point on the outer lens surface at the frame center Cf, a broken line along the cylinder axis Ac at the angle $\alpha$ from Ah for properly orienting the lens block for surfacing cutting, and a line segment along the axis Ap at the angle $\beta$ from Ah to indicate the direction of prism. The lens block is then attached with its center directly over the frame center Cf and oriented such that, when placed in the chuck of a cutting tool, the cylinder axis of the cutting tool corresponds to the cylinder axis Ac. The lens block is placed into the chuck such that the blank is also tilted with respect to the cutting tool at an angle corresponding to the calculated prism power and in the calculated direction Ap such that when the cutting tool is applied to produce the inner surface of the lens the optical center Co will occur at the proper decentration from the frame center Cf of the lens.

Typically the prism tilt is accomplished, in a manner known to the art, by placing a tapered spacer or prism ring around the lens block 16 between the lens blank 10 and the chuck of the cutting tool, such prism ring being marked in prism diopters for a standard lens material having a given index of refraction. (Alternatively the proper amount of prism may be achieved by mounting the lens block 16 on the lens blank 10 at a predetermined tilt by placing more lead under one side than the other.)

Since the lens material actually being used will often not correspond to the lens material for which a prism ring is marked, the proper marked prism figure to obtain the required calculated prism power will usually have to be computed by a simple conversion known to the art based upon the index of refraction of the lens material being utilized as follows:

$$\text{Marked prism power } P_\beta'=P_\beta(Nm-1)/(Nu-1)$$

where Nm is the refractive index of the material for which the prism ring is marked and Nu is the refractive index of the material actually being used.

Figure 3:
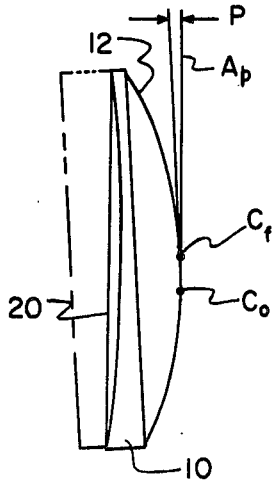
FIG. 3 is a side elevation of a lens blank the inner surface of which has been cut utilizing frame-center blocking and the application of prism to tilt the blank relative to the cutting tool to achieve decentration in accordance with the present invention.

When the lens blank 10 is held in the chuck of the cutting tool in accordance with the foregoing requirements, it is tilted with respect to the chuck at a predetermined prism angle P, corresponding to the calculated resultant prism power, $P_\beta$ (or $P_\beta'$ if such conversion is necessary), along the axis Ap as shown in FIG. 3. This produces a tilted inner lens surface 20 such that the optical center Co (the thickest portion of the plus lens illustrated) is shifted the proper amount of decentration D from the frame center Cf along the axis Ah.

After the lens is cut it is ground and polished in one or more stages, ordinarily on a lap, to eliminate slight errors in the shape of the curve and to produce a smooth finished surface. Since the lens block 16 has in the past conventionally been placed on the optical center of the lens blank 10 for surfacing, and thereafter removed so that the lens may be reblocked on the frame center for edging, testing of the lens refractive power in a lensometer has typically taken place after the lens has been unblocked from the optical center. However, since the present system utilizes frame-center blocking for both the surfacing and edging operations, it is more desirable to leave the block or a portion 22 thereof in place for both operations. Accordingly, if it is desired to test the lens power after the surfacing operation, this can be accomplished by measuring its thickness at predetermined critical points along the axis Ap rather than in a lensometer which would require removal of the block.

EXAMPLE

A prescription specifies the following parameters for a sphero-cylindrical lens for the right eye of a patient:

| Sphere Power | Cylinder Power | Cylinder Axis | Pupilary Distance |
|---|---|---|---|
| +2.00 | −1.00 | 60° | 29.0mm |

The prescribed frame style has frames having horizontal widths of 48 mm and a bridge width of 20 mm, and horizontal decentration is prescribed. The required decentration along Ah therefore is 5 mm, calculated as follows:

$$48.0\text{ mm}/2+20\text{ mm}/2-29.0\text{ mm}=5.0\text{ mm}$$

The decentration components Dc, Ds along the axes Ac, As are computed as follows:

$$Dc=5.0\text{ mm}\cos(-60°)=2.5\text{ mm}$$

$$Ds=5.0\text{ mm}\sin(-60°)=-4.33\text{ mm}$$

Using Prentice's rule, the prism power components Pc, Ps along Ac and As, are determined as follows:

$$Pc=(2.50)(+2.00)/10=0.5\text{ prism diopters}$$

$$Ps=(-4.33)(+1.00)/10=-0.433\text{ prism diopters}$$

Using Pc and Ps the resultant prism power $P_\beta$ and prism axis angle $\beta$ may then be calculated.

$$P_\beta=\sqrt{(0.5)^2+(-0.433)^2}=0.66\text{ prism diopters}$$

$$\beta=60°+\tan^{-1}(-0.433/0.5)=19.1°$$

If it is desired to use a prism ring to insert the proper amount of prism in the system, and the lens material to be used is crown glass, having an index of refraction of 1.523, and assuming that the prism rings are marked for use with Canadian balsam glass having an index of refraction of 1.530, as is usually the case, then the following conversion calculation must be made to select the marked value $P_\beta'$ of the prism ring to be used to produce the proper amount of prism for the exemplary lens:

$$P_\beta'=(0.66)(1.530-1.0)/(1.523-1.0)=0.67\text{ prism diopters}$$

Therefore, a prism ring marked for 0.67 prism diopters, or as close thereto as possible, should be selected and placed around the lens block (which has been attached to the lens so as to be centered on frame center Cf) with the apex of the prism ring in the direction of the marked line segment along the axis Ap at an angle of 19.1° relative to the axis Ah such that the lens blank will be tilted further from the cutting tool in that direction. The blocked lens should be positioned in the chuck of the cutting tool so as to be ground along the cylinder axis Ac which is 60° from the horizontal frame axis Ah. The resultant decentration will be 5.0 mm along the axis Ah.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of surfacing and edging a sphero-cylindrical spectacle lens requiring a decentration of the optical center of the lens a predetermined distance from the frame center thereof along a predetermined axis oblique to the cylinder axis of the sphero-cylindrical lens surface, said method comprising:

(a) attaching a lens-holding edging and surfacing lens block to the outer surface of said lens such that said lens block is centered on the frame center of said lens;

(b) cutting the inner surface of said lens to a predetermined sphero-cylindrical shape by means of a cutting tool while holding said lens by said lens block relative to said cutting tool in a position tilted with respect to a position wherein the optical center of said lens, resulting from said cutting, would be coincident with the frame center thereof, such that the actual optical center is decentered from said frame center by said predetermined distance along said predetermined axis due to said tilting; and (c) while said lens block is centered on said frame center of said lens, forming a peripheral edge of predetermined configuration around said lens while holding said lens by said lens block.

* * * * *

UNITED STATES PATENT AND TRADEMARK OFFICE

CERTIFICATE OF CORRECTION

PATENT NO. : 4,149,344

DATED : April 17, 1979

INVENTOR(S) : Gordon H. Keane, Jr.

It is certified that error appears in the above-identified patent and that said Letters Patent are hereby corrected as shown below:

| | | |
|---|---|---|
| Col. 2, | line 21 | After "from the" delete the word --outer--. |
| Col. 4, | line 20 | After "smaller" add the word --lens--. |
| Col. 6, | line 62 | Change "prims" to --prism--. |
| Col. 7, | line 23 | After "that the" add the word --lens--; |
| Col. 7, | line 43 | After "conversion" add the word --formula--. |

Signed and Sealed this

*Twenty-eighth* Day of *August 1979*

[SEAL]

*Attest:*

*Attesting Officer*

LUTRELLE F. PARKER

*Acting Commissioner of Patents and Trademarks*